US006744304B2

(12) United States Patent
Egerer et al.

(10) Patent No.: US 6,744,304 B2
(45) Date of Patent: Jun. 1, 2004

(54) CIRCUIT FOR GENERATING A DEFINED TEMPERATURE DEPENDENT VOLTAGE

(75) Inventors: Jens Egerer, München (DE); Heiko Fibranz, München (DE); Eckehard Plaettner, Oberhaching (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/234,078

(22) Filed: Sep. 3, 2002

(65) Prior Publication Data

US 2003/0048128 A1 Mar. 13, 2003

(30) Foreign Application Priority Data

Sep. 1, 2001 (DE) ..... 101 43 032

(51) Int. Cl.[7] ..... G05F 3/22; G05F 1/46
(52) U.S. Cl. ..... 327/540; 327/539; 323/314
(58) Field of Search ..... 327/513, 539, 327/540, 541; 323/313, 314, 907

(56) References Cited

U.S. PATENT DOCUMENTS 5,767,664 A 6/1998 Price ..... 323/907
6,222,470 B1 * 4/2001 Schuelke ..... 327/539
6,362,612 B1 * 3/2002 Harris ..... 323/313
6,489,835 B1 * 12/2002 Yu et al. ..... 327/539
2003/0151396 A1 * 8/2003 Self et al. ..... 323/312

* cited by examiner

*Primary Examiner*—Timothy P. Callahan
*Assistant Examiner*—Terry L. Englund
(74) *Attorney, Agent, or Firm*—Laurence A. Greenberg; Werner H. Stemer; Ralph E. Locher

(57) ABSTRACT

An electronic circuit for generating an output voltage has a defined temperature dependence, a bandgap circuit for generating a defined temperature-constant voltage and a temperature-dependent current with a defined temperature dependence, and a conversion circuit for generating the output voltage from the temperature-dependent current and the temperature-constant voltage. The conversion circuit has a first resistor at whose first terminal the temperature-constant voltage is applied, and whose second terminal is connected to a first terminal of a second resistor. The second terminal of the second resistor is connected to a supply voltage potential, and a first terminal of a third resistor is connected to the second terminal of the first resistor. The temperature-dependent current is supplied to a second terminal of the third resistor, and it being possible to tap the output voltage at the second terminal of the third resistor.

11 Claims, 1 Drawing Sheet

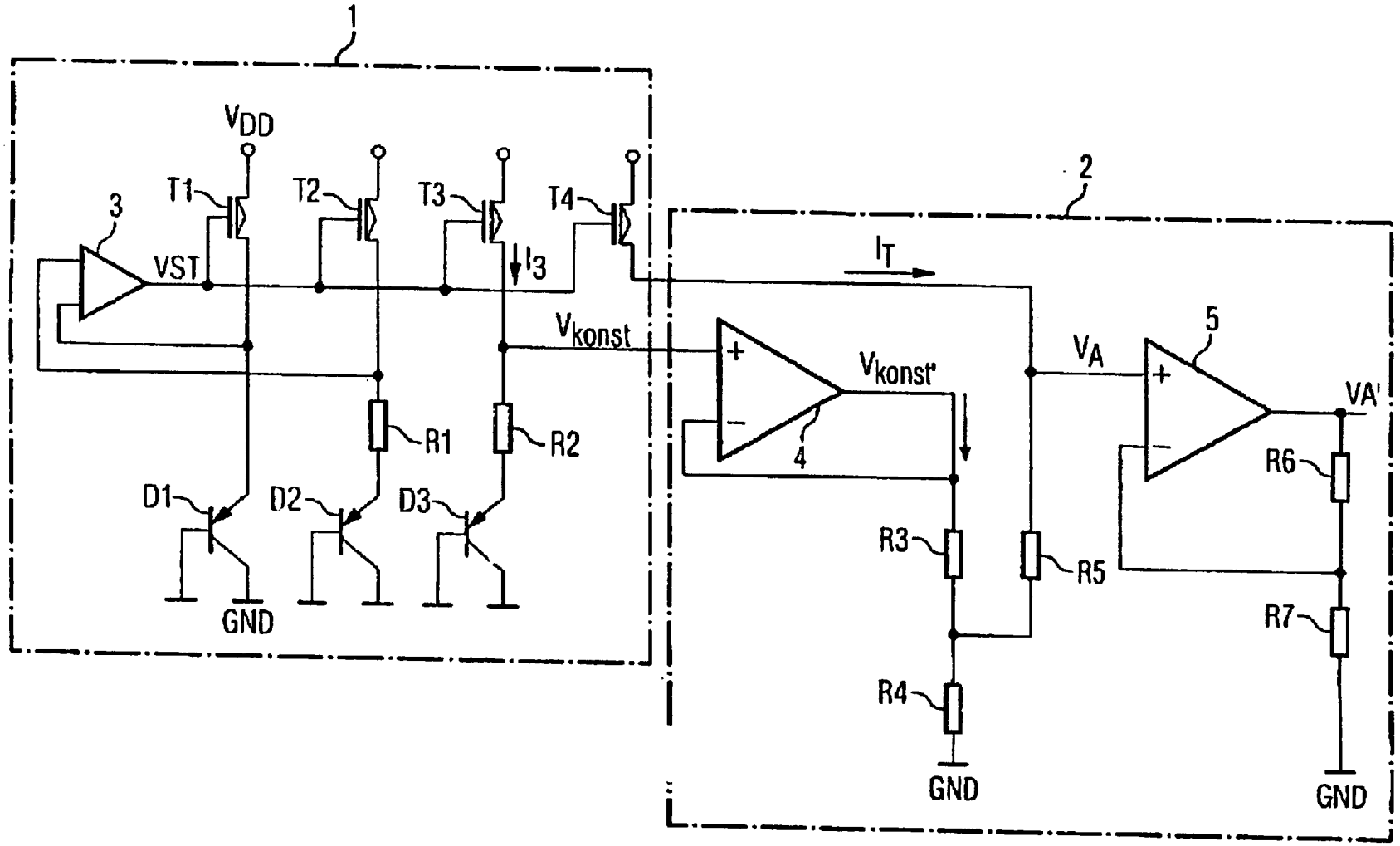
1
2
3
4
5
VDD
T1
T2
T3
T4
VST
I3
Vkonst
R1
R2
D1
D2
D3
GND
IT
Vkonst'
R3
R4
R5
VA
R6
R7
VA'

CIRCUIT FOR GENERATING A DEFINED TEMPERATURE DEPENDENT VOLTAGE

BACKGROUND OF THE INVENTION

Field of the Invention

The invention relates to an electronic circuit for generating an output voltage having a defined temperature dependence.

In order to adjust signal transit times, use is frequently made in integrated circuits of time-delay circuits for the purpose of adjusting signals, such as clock signals, for example, to one another. The time-delay circuits serve the purpose, in particular, of making available at each point in the integrated circuits a clock signal that is synchronized with the clock signals that are tapped at other points in the integrated circuit. The time-delay circuits are configured so as to effect a prescribable time delay of the input signal with reference to an output signal. Conventional time delay circuits are, however, temperature-dependent. As a result, the respective signals experience a different time delay as a function of the ambient temperature and/or the junction temperature. The time-delay interval of the time delay circuits is influenced, in particular, during the heating of the integrated circuit as it is being used. Since a plurality of time delay circuits with different time-delay intervals are frequently provided, and since the signal transit times via line lengths are essentially not temperature-dependent, the result of this is that the signals become asynchronous relative to one another.

SUMMARY OF THE INVENTION

It is accordingly an object of the invention to provide an electronic circuit for generating an output voltage having a defined temperature dependence which overcomes the above-mentioned disadvantages of the prior art devices of this general type, and provides a time-delay circuit that makes a temperature-dependent time delay available in a simple way.

With the foregoing and other objects in view there is provided, in accordance with the invention, an electronic circuit. The electronic circuit has a bandgap circuit for generating a defined temperature-constant voltage and a temperature-dependent current, and a conversion circuit connected to the bandgap circuit and generating an output voltage from the temperature-dependent current and the defined temperature-constant voltage. The output voltage has a defined temperature dependence.

According to the invention, the electronic circuit for generating the output voltage having the defined temperature dependence is provided. The electronic circuit has a bandgap circuit with the aid of which it is possible to generate a temperature-constant voltage and a temperature-dependent current having the defined temperature dependence. The electronic circuit also has the conversion circuit in order to generate the output voltage from the temperature-dependent current and the temperature-constant voltage. It is possible thereby to generate an output voltage having the defined temperature dependence that can be applied as a supply voltage to a time delay circuit in order to set the delay time.

The conversion circuit can preferably have a first resistor at whose first terminal the temperature-constant voltage is applied, and whose second terminal is connected to a first terminal of a second resistor. The second terminal of the second resistor is connected to a supply voltage potential. A first terminal of a third resistor is connected to the second terminal of the first resistor. The temperature-dependent current is supplied to a second terminal of the third resistor, in which it is possible to tap the output voltage at the second terminal of the third resistor.

Bandgap circuits are circuits that are frequently used in integrated circuits in order to generate temperature-constant voltages. The bandgap circuits can also be used for the purpose of generating a current with a defined temperature-dependence. The conversion circuit now provides for the temperature-dependent current to be converted into a temperature-dependent voltage with the aid of the third resistor, and for the voltage to be added to the temperature-constant voltage impressed via the second resistor. The output voltage can be set in a defined fashion by the suitable selection of the first, second and third resistors as well as given knowledge of the temperature dependence of the temperature-dependent current and the temperature-constant voltage. The output voltage can then be used, for example, as a supply voltage for a suitable time-delay circuit, as a result of which the temperature dependence of the time-delay circuit is compensated by the temperature dependence of the supply voltage.

It can be provided that the output voltage is connected to a high-resistance input of an amplifier circuit in order to decouple the output voltage from a subsequent low-resistance consumer such that substantially no current flows off from the second terminal of the third resistor during tapping of the amplified output voltage. In this way, the conversion circuit can be set more accurately to the desired temperature dependence of the output voltage, since an input resistance of a connected amplifier circuit or similar downstream circuit need not be known. It is therefore possible to set the temperature-dependent portion of the output voltage merely through knowledge of the temperature-dependent current and the resistance value of the third resistor.

It can be provided, furthermore, that the bandgap circuit has a first transistor whose first terminal is connected to a second supply voltage potential and whose second terminal is connected to a first terminal of a first diode. The second terminal of the first diode is connected to the first supply voltage potential. The bandgap circuit also has a second transistor, whose first terminal is connected to the second supply voltage potential and whose second terminal is connected to a first terminal of a fourth resistor. A second terminal of the fourth resistor is connected to a first terminal of a second diode, the second terminal of the second diode being connected to the first supply voltage potential. Present at the control inputs of the first transistor and the second transistor is a control voltage that depends on the voltage difference between the second terminal of the first transistor and the second terminal of the second transistor, such that the transistors connected to the control voltage are operated at one operating point.

Both a constant voltage and a temperature-dependent current can be generated with the aid of the control voltage thus generated, which has a prescribed temperature dependence. Provided for this purpose is, for example, a third transistor, whose first terminal is connected to the second supply voltage potential, and at whose second terminal it is possible to tap the temperature-dependent current. For this purpose, the temperature-dependent control voltage is applied at the control input of the third transistor. Since the third transistor is likewise operated at an operating point, the dependence of the current at the second terminal of the third transistor is substantially determined by the control voltage.

In order to-generate the constant voltage, a fourth transistor is provided whose first terminal is connected to the second supply voltage potential and whose second terminal is connected to the first terminal of a fifth resistor. A second terminal of the fifth resistor is connected to a first terminal of a third diode, a second terminal of the third diode being connected to the first supply voltage potential. A control input of the fourth transistor is connected to the temperature-dependent control voltage.

A fixed temperature-dependent current that effects a temperature-dependent voltage drop across the fifth resistor flows in a fashion controlled by the control voltage through the fourth transistor. Owing to the temperature dependence of the diode, which is likewise known, the voltages are added together via the third diode and via the fifth resistor. This also results in the setting for the control voltage and the temperature dependence thereof. The surface area ratio of the first diode to the second diode is selected such that there flows through the fourth transistor a specific current that generates a specific voltage drop in the fifth resistor. The voltage drop across the fifth resistor and the voltage drop across the third diode are necessarily temperature-dependent in opposite ways, and so the temperature dependences cancel one another out, that is to say the sum of the voltage drops across the fifth resistor and the third diode is substantially constant. A temperature-constant voltage can be tapped in this way at the first terminal of the fifth resistor.

The bandgap circuit according to the invention thus renders it possible to make available a temperature-constant voltage, and a current that is temperature-dependent in a defined fashion and is converted in an appropriate conversion circuit into an output voltage that is temperature-dependent in a defined fashion and has a predetermined temperature dependence.

In accordance with an added feature of the invention, the first diode and the second diode have identical temperature dependencies. The third diode has a temperature dependency of approximately −2 mV/K.

In accordance with another feature of the invention, the fourth resistor and/or the fifth resistor has a temperature dependency.

In accordance with an additional feature of the invention, the first, second, third and/or fourth transistor is a field-effect transistor. The first, second and/or third diode is a bipolar transistor having a base terminal set at an equivalent potential as the second terminal of the diode.

In accordance with a further feature of the invention, the first diode and the second diode have active surfaces with a predetermined surface area ratio.

Other features which are considered as characteristic for the invention are set forth in the appended claims.

Although the invention is illustrated and described herein as embodied in an electronic circuit for generating an output voltage having a defined temperature dependence, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing is a circuit diagram of an electronic circuit for generating an output voltage having a defined temperature dependence according to the invention.

DESCRIPTION OF THE PREFERRED EMBODIMENTS

Referring now to the single FIGURE of the drawing in detail, there is shown an electronic circuit that has a bandgap circuit 1 and a conversion circuit 2. The bandgap circuit 1 is a bandgap circuit that is normally used in integrated circuits and with the aid of which a temperature-constant voltage is made available. A temperature-dependent current having the defined temperature dependence can likewise be generated in the bandgap circuit 1 after a slight modification.

The temperature-constant voltage and the temperature-dependent current are used in the conversion circuit 2 for the purpose of generating a voltage having the defined temperature dependence.

The bandgap circuit 1 has a first transistor $T_1$ whose first terminal is connected to a high supply voltage potential VDD, and whose second terminal is connected to a first terminal of a first diode $D_1$. A low supply voltage potential GND that is preferably a ground potential is present at a second terminal of the first diode $D_1$.

The bandgap circuit 1 also has a second transistor $T_2$, whose first terminal is connected to the high supply voltage potential VDD. A second terminal of the second transistor $T_2$ is connected to a first terminal of a first resistor $R_1$. A second terminal of the first resistor $R_1$ is connected to a first terminal of a second diode $D_2$. A second terminal of the second diode $D_2$ is connected to the low supply voltage potential GND.

A voltage difference is tapped between the second terminal of the first transistor $T_1$ and the second terminal of the second transistor $T_2$, and fed to an amplifier circuit 3. The output of the amplifier circuit 3 makes available a control voltage $V_{ST}$ that is connected to control inputs of the first transistor $T_1$ and the second transistor $T_2$, such that the transistors $T_1$, $T_2$ are controlled to one operating point. That is to say the control voltage $V_{ST}$ is controlled such that the voltages at the second terminal of the first transistor $T_1$ and the second terminal of the second transistor $T_2$ are equal. The control voltage $V_{ST}$ at the output of the amplifier circuit 3 has a temperature dependence with a positive temperature gradient.

The bandgap circuit 1 has a third transistor $T_3$, whose first terminal is connected to the high supply voltage potential VDD. A second terminal of the third transistor $T_3$ is connected to a first terminal of a second resistor $R_2$. A second terminal of the second resistor is connected to a first terminal of a third diode $D_3$. A second terminal of the third diode $D_3$ is connected to the low supply voltage potential GND.

A temperature-constant output voltage $V_{konst}$ can be tapped in the bandgap circuit 1 at the first terminal of the second resistor $R_2$. The output voltage $V_{konst}$ is constant over a temperature, since the temperature-dependent individual voltages across the second resistor $R_2$ and the third diode $D_3$ add up to form a constant voltage. The third diode $D_3$ has a negative temperature dependence such as, for example, −2 mV/K. The current $I_3$ flowing through the third transistor $T_3$ flows through the second resistor $R_2$ and gives rise there to a voltage drop with a positive temperature dependence, in this case preferably +2 mV/K.

The temperature dependence of the current $I_3$ results from the temperature-dependent control voltage VST that is output by the amplifier circuit 3. The control voltage $V_{ST}$ is present at the control input of the third transistor $T_3$, as a result of which the current flow through the third transistor $T_3$ is controlled. The temperature dependence of the control voltage $V_{ST}$ is a function of a temperature voltage $V_T$, the natural logarithm of the surface area ratio between the active diode surface area $A_{02}$ of the second diode $D_2$ and the diode surface area $A_{D1}$ of the first diode $D_1$, as well as of the first resistor $R_1$. Given a surface area ratio of greater than 1, this results in a positive temperature dependence of the control voltage, and thus in a positive temperature dependence of the current $I_3$. The gradient of the temperature dependence can be determined via the gain of the amplifier circuit 3, the resistance value $R_1$, the surface area ratio between the second diode $D_2$ and the first diode $D_1$.

The resistance value of the second resistor $R_2$ is preferably determined by the first resistor $R_1$ and the desired temperature dependence.

The bandgap circuit 1 also has a fourth transistor $T_4$, whose first terminal is connected to the high supply voltage potential VDD. It is possible to tap at the second terminal of the fourth transistor $T_4$ a current $I_T$ that, in a fashion controlled by the temperature-dependent control voltage $V_{ST}$ at the output of the amplifier circuit 3, the surface area ratio $A_{D2}$ and $A_{D1}$ of the second diode $D_2$ and the first diode $D_1$ and the gain of the amplifier circuit 3, can be set.

The transistors $T_1$ to $T_4$ are preferably field-effect transistors, in particular as p-channel field-effect transistors. Use is preferably made, as diodes, of bipolar transistors whose base contact is connected to the collector terminal, and is therefore at the same potential, specifically the low supply voltage potential GND, as the collector terminal. As a result, the first terminal of the first, second and third diodes is formed in each case by an emitter terminal of a bipolar transistor, while the base and collector terminal of the respective bipolar transistor, short-circuited relative to one another, respectively form the second terminal of the respective diode.

When use is made of identical transistors $T_1$ to $T_4$, the result for the temperature dependence of the current $I_T$ is:

$$I_T = \frac{V_T \cdot \mathrm{Ln}(A_{D2}/A_{D1})}{R_1}$$

The constant voltage $V_{konst}$ is therefore determined as follows:

$$V_{konst}=R_2 \cdot I_T+V_{D3},$$

$V_{D3}$ corresponding to the threshold voltage across the p-junction of the third diode $D_3$.

A temperature-dependent output voltage VA is generated in the conversion circuit 2 from the constant output voltage $V_{konst}$ and the temperature-dependent current $I_T$. The first step for this purpose is to provide a voltage follower 4 that is preferably a difference amplifier. The temperature-constant voltage $V_{konst}$ is supplied to the positively amplifying input of the difference amplifier 4. Since the output of the difference amplifier 4 is fed back directly to the negatively amplifying input of the difference amplifier 4, the difference amplifier operates as a voltage follower. That is to say an identical voltage $V_{konst'}$ is present at the output of the difference amplifier 4, in a fashion decoupled from the constant voltage $V_{konst}$. The difference amplifier 4 is used so that the constant voltage $V_{konst}$ from the bandgap circuit 1 is supplied to a high-resistance input such that as far as possible no current flows off into the bandgap circuit 1 upstream of the first terminal of the second resistor $R_2$. It is possible in this way to prevent the setting of the constant voltage $V_{konst}$ from being disturbed by a parasitic current flow from the bandgap circuit 1, and thereby being rendered difficult.

The decoupled constant voltage $V_{konst'}$ is present at a first terminal of a third resistor $R_3$. A second terminal of the third resistor $R_3$ is connected to a first terminal of a fourth resistor $R_4$. A second terminal of the fourth resistor $R_4$ is connected to the low supply voltage potential GND. The first terminal of the fourth resistor $R_4$ is connected to a first terminal of a fifth resistor $R_5$. The second terminal of the fifth resistor $R_5$ is connected to the second terminal of the fourth transistor $T_4$ of the bandgap circuit 1 such that the temperature-dependent current $I_T$ is supplied to the fifth resistor $R_5$ and the fourth resistor $R_4$. There then flows in the fourth resistor $R_4$ a current that results from the current flow through the third resistor $R_3$ and the fifth resistor $R_5$.

The output voltage $V_A$ of the conversion circuit 2 is present at the second terminal of the fifth resistor. It is yielded in accordance with the following formula:

$$V_A = I_T \cdot (R_4 + R_5) + \frac{V_{konst} - R_R \cdot I_T}{1 + R_3 I R_4} \text{ where}$$

$$I_T = V_T \cdot \frac{\ln(n)}{R_1}$$

It is to be seen that the temperature dependence of the output voltage $V_A$ can be set by resistors $R_3$, $R_4$ and $R_5$ given knowledge of the temperature dependence of the current $I_T$ and of the voltage value of the constant voltage $V_{konst}$.

In order not to divert any portion of the current $I_T$ from the branch circuit formed by the fifth resistor $R_5$, the output voltage $V_A$ is tapped via a difference amplifier 5. The output voltage $V_A$ is present at the positively amplified input of the difference amplifier 5. The difference amplifier 5 is fed back to the negatively amplifying input of the difference amplifier 5 via a sixth resistor $R_6$. The negatively amplifying input of the difference amplifier 5 is likewise connected to the low supply voltage potential GND via a seventh resistor $R_7$. The gain of the difference amplifier 5 can be set via the sixth resistor $R_6$ and the seventh resistor $R_7$ such that the output voltage $V_A$ is amplified to form an output voltage $V_{A'}$ that can be tapped. The temperature dependence is likewise amplified in this case in accordance with the gain.

The tappable output voltage $V_{A'}$ is then made available for supplying time delay circuits or similar temperature-dependent circuits whose temperature dependence is to be compensated.

It is usual for sheet resistances that are used to exhibit an intrinsic thermal characteristic. If the same type of resistor is used in each case for the first, second, third, fourth and fifth resistors $R_1$, $R_2$, $R_3$, $R_4$ $R_5$, the output voltage is generated as a function of the constant voltage $V_{konst}$ and the temperature-dependent current $I_T$, but not of the sheet resistance of the type of resistor used.

The features of the invention that are disclosed in the previous description, the claims and the drawing can be essential both individually and in any combination for the implementation of the invention in its various refinements.

We claim:

1. An electronic circuit, comprising:

a bandgap circuit for generating a defined temperature-constant voltage and a temperature-dependent current; and a conversion circuit connected to said bandgap circuit and generating an output voltage from the temperature-dependent current and the defined temperature-constant voltage, the output voltage having a defined temperature dependence, said conversion circuit containing:

a terminal for a supply voltage potential;

a first resistor having a first terminal receiving the defined temperature-constant voltage, and a second terminal;

a second resistor having a first terminal connected to said second terminal of said first resistor, and a second terminal connected to said terminal for the supply voltage potential; and a third resistor having a first terminal connected to said second terminal of said first resistor, and a second terminal receiving the temperature-dependent current, and the output voltage being available at said second terminal of said third resistor.

2. The electronic circuit according to claim 1, wherein said conversion circuit further has an amplifier circuit with a high-resistance input receiving the output voltage and amplifies the output voltage resulting in an amplified output voltage such that substantially no current flows off from said second terminal of said third resistor during a tapping of the amplified output voltage.

3. The electronic circuit according to claim 2, wherein said bandgap circuit includes:

a further terminal for receiving the supply voltage potential;

a first transistor having a control input, a first terminal for connecting to a further supply voltage potential, and a second terminal;

a first diode having a first terminal connected to said second terminal of said first transistor and a second terminal connected to said further terminal for the supply voltage potential;

a second transistor having a control input, a first terminal for connecting to the further supply voltage potential, and a second terminal;

a fourth resistor having a first terminal connected to said second terminal of said second transistor and a second terminal; and a second diode having a first terminal connected to said second terminal of said fourth resistor and a second terminal connected to said further terminal for the supply voltage potential, and present on said control input of said first transistor and said control input of said second transistor is a control voltage dependent on a voltage difference between said second terminal of said first transistor and said second terminal of said second transistor, such that said first and second transistors connected to the control voltage being operated at one operating point.

4. The electronic circuit according to claim 3, wherein said first diode and said second diode have an identical temperature dependence.

5. The electronic circuit according to claim 3, wherein said bandgap circuit further includes a third transistor having a control input, a first terminal for connecting to the further supply voltage potential, and a second terminal at which the temperature-dependent current can be tapped, and the control voltage being applied at said control input of said third transistor.

6. The electronic circuit according to claim 5, wherein said bandgap circuit further includes:

a fourth transistor having a control input, a first terminal for connecting to the further supply voltage potential, and a second terminal, said control input of said fourth transistor receiving the control voltage, and the temperature-constant voltage can be tapped at said second terminal of said fourth transistor;

a fifth resistor having a first terminal connected to said second terminal of said fourth transistor, and a second terminal; and a third diode having a first terminal connected to said second terminal of said fifth resistor and a second terminal connected to said further terminal for the supply voltage potential.

7. The electronic circuit according to claim 6, wherein said third diode has a temperature dependence of approximately –2 mv/K.

8. The electronic circuit according to claim 6, wherein at least one of said fourth resistor and said fifth resistor has a temperature dependence.

9. The electronic circuit according to claim 6, wherein at least one of said first, second, third and fourth transistors is a field-effect transistor.

10. The electronic circuit according to claim 6, wherein at least one of said first, second and third diodes is a bipolar transistor having a base terminal set at an equivalent potential as said second terminal of said diode.

11. The electronic circuit according to claim 6, wherein said first diode and said second diode have active surfaces with a predetermined surface area ratio.

* * * * *